United States Patent [19]

Jakub

[11] Patent Number: 5,062,159

[45] Date of Patent: Nov. 5, 1991

[54] PATIENT'S HOSPITAL GOWN

[76] Inventor: Beatrice Jakub, 2570 N. Pontiac Trail, Walled Lake, Mich. 48088

[21] Appl. No.: 572,869

[22] Filed: Aug. 27, 1990

[51] Int. Cl.[5] ..... A41D 13/00; A41D 13/12

[52] U.S. Cl. ..... 2/114; 2/70; 2/105; 2/DIG. 7

[58] Field of Search ..... 2/70, 71, 75, 80, 83, 2/105, 106, 114, 220, 221, 223, DIG. 6, DIG. 7

[56] References Cited

U.S. PATENT DOCUMENTS

| | | | |
|---|---|---|---|
| 715,248 | 12/1902 | McDavis | 2/70 X |
| 818,351 | 4/1906 | Clark | 2/114 |
| 998,774 | 7/1911 | Howenstine | 2/221 |
| 1,122,737 | 12/1914 | Guinan | 2/221 |
| 1,141,284 | 6/1915 | Stone | 2/221 |
| 1,433,635 | 10/1922 | McMahan | 2/221 |
| 2,148,344 | 2/1939 | Freedman | 2/70 |
| 2,707,282 | 5/1955 | Paterson | 2/114 |
| 2,807,022 | 9/1957 | Bonanni | 2/114 |
| 2,849,716 | 9/1958 | Kerson | 2/70 |
| 4,422,186 | 12/1983 | Loney | 2/114 |
| 4,570,268 | 2/1986 | Freeman | 2/114 |
| 4,590,624 | 5/1986 | Weiser | 2/114 |
| 4,759,083 | 7/1988 | Belcher | 2/114 |
| 4,787,101 | 11/1988 | Feinberg | 2/105 |

OTHER PUBLICATIONS

Velcro Product News, Velcro Corp., New York, Oct.-Nov. 1976, PN No. 27.

Dritz, Velcro Tape Fasteners, Scoville, Sep. 1972, 2-DIG. 6.

*Primary Examiner*—Werner H. Schroeder
*Assistant Examiner*—Jeanette E. Chapman
*Attorney, Agent, or Firm*—John R. Benefiel

[57] ABSTRACT

A patient's hospital gown comprised of a wrap around lower portion secured with a waist drawstring and a series of releasable fasteners along the overlapped seam. Front and rear panels are sewn to the top edge of the nether portion, forming main front flap looping an auxiliary front panel attached to one of rear panel sleeves and drawn over the wearer's shoulder and onto one side of the wearer's chest. Other sleeve portions of the main front and rear panels have a releasable seam extending along the top edge.

8 Claims, 2 Drawing Sheets

PATIENT'S HOSPITAL GOWN

This invention concerns garments and more particularly gowns to be worn by patients in hospitals, which gowns are suited to facilitate medical examinations and treatments without requiring its removal.

Hospitals have long provided gowns for patients which are designed to allow convenient access to various portions of the patient's anatomy for routine medical treatments, such as the placement of IV needles in either arm; and medical examinations such as taking blood pressure measurements and those examinations requiring stethoscope application to the patient's chest.

At the same time, for the sake of the patient's comfort such gowns should be convenient and also reasonably attractive, and provide for the patient's sense of modesty.

Hospital personnel should also be able to easily configure the gown parts as necessary to conduct examinations and treatments, and for other patient care needs.

The gown is advantageously able to be stocked in a unisex style and with minimum number of sizes to simplify the hospital logistical requirements.

There has heretofore been provided hospital gowns which had various openable panels and sleeves for patient access without the need for disrobing, but no design has provided a gown in which all of the desirable features described have been provided.

SUMMARY OF THE INVENTION

The present invention is a hospital gown comprised of a lower portion formed by a fabric panel wrapped around the waist of the patient with a vertical overlapped openable seam on one side of the front of the gown. The overlapped front seam is held closed with a series of hook and loop fasteners. An encircling waist drawstring is provided received in a hem extending about the upper edge of the lower portion.

A central hook and loop fastener at the center of the bottom edge enables partial bifurcation of the lower portion of the gown.

Separate spaced front and rear located upper body panels are sewn to the upper edge of the lower portion to form a gown upper portion. The front upper body panel is sewn along a seam extending for a short segment of the right front side of the lower portion but has an unsewn flap portion extending to the left side. The upper body rear panel is sewn across the back upper edge of the gown lower portion and has an auxiliary front panel sewn to an upper sleeve edge of the rear upper body panel.

The auxiliary front panel is adapted to be drawn over the left arm, forming an open bottomed sleeve and over the right side of the wearer's chest. The right side edge of the front panel is drawn over the edge of the auxiliary front panel, overlapping the same and releasably secured thereto with a series of hook and loop fasteners.

A right sleeve section of the rear upper body panel is adapted to be releasably secured to a corresponding sleeve section of the front upper body panel along an overlapping seam, forming a right sleeve, open at the bottom.

The various overlapped releasable seams are preferably trimmed with contrasting piping to provide a visual cue as to their location, and the various fasteners can also be color coded as to garment size.

The hook sections of the hook and loop fasteners are preferably provided with mating cover swatches to prevent clogging during laundering.

The gown allows ready access to either the right or the left arm or the entire chest; the lower portion is comfortably well fit, and completely covers the wearer's anatomy without any openings to satisfy the modesty of the wearer, but also provides for ready access to any part of the wearer's anatomy for medical treatments and/or examinations.

The gown construction is simple and efficient in use of fabric material such as to be able to be manufactured at a reasonable cost, and suitable for stocking by hospitals and similar institutions having a need for patient's gowns.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
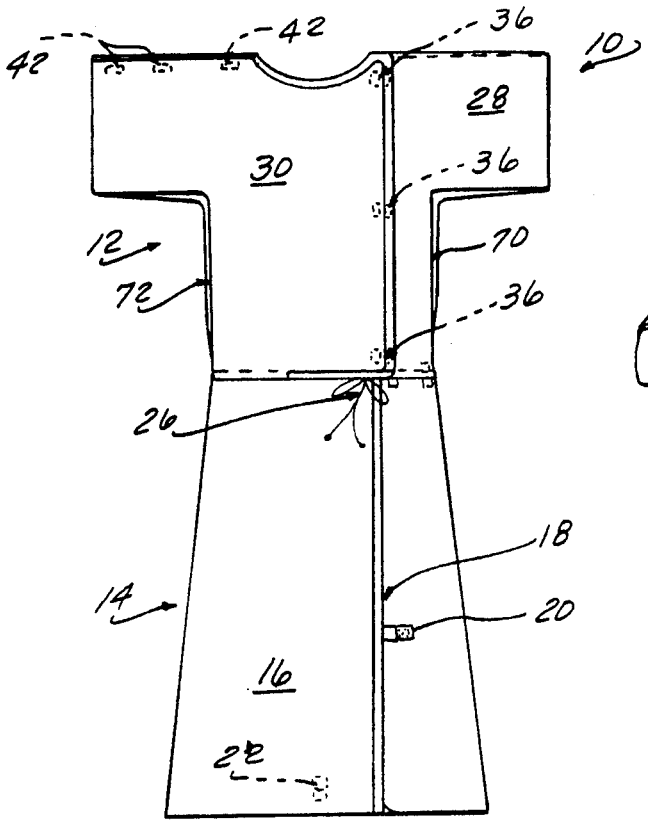
FIG. 1 is a front view of the patients hospital gown according to the present invention, with all of the openable seams closed.
Figure 2:
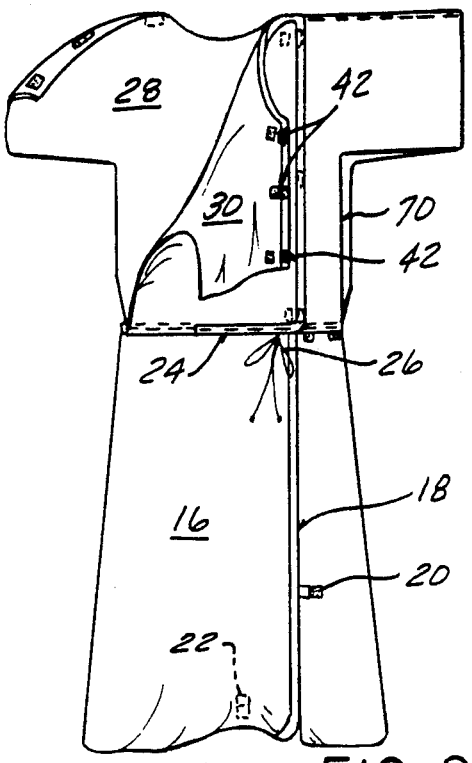
FIG. 2 is a front view of the gown shown in FIG. 1 with the right sleeve opened by release of the upper right sleeve seam.
Figure 3:
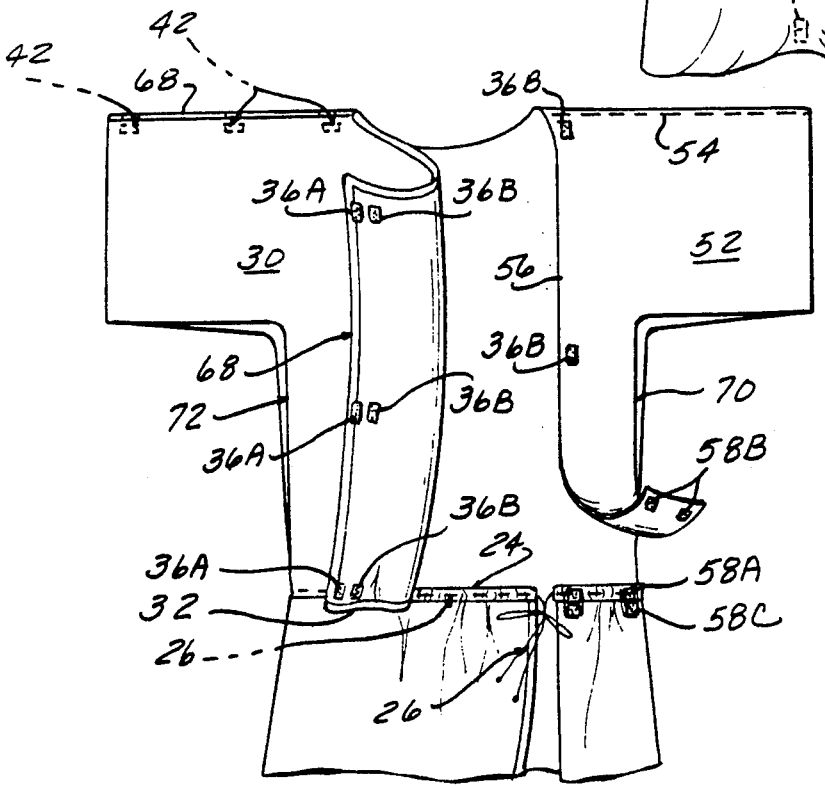
FIG. 3 is an enlarged fragmentary front view of the gown shown in FIGS. 1 and 2 with front panel seam opened and the left sleeve auxiliary front panel section connection to the upper edge of the nether portion released.

Referring to FIG. 1, the patients hospital gown 10 according to the present invention consists of an upper body portion 12 joined to a nether or lower portion 14.

The lower portion 14 is comprised of a fabric panel 16 adapted to be wrapped around the waist of a wearer, the edges of the panel overlapped to form a vertical releasable seam 18 extending down the front of the wearer, preferably on the left side of the wearer. The releasable seam 18 is secured by one or more of hook and loop fasteners 20 (sold under the trademark VELCRO). A single central fastener 22 may be provided at the bottom edge to loosely bifurcate the skirt like lower portion 14 as may be desired by male wearers.

The upper edge of the lower portion is formed with a loose hem 24 receiving a drawstring 26 drawn snugly and tied after donning the gown.

Figure 4:
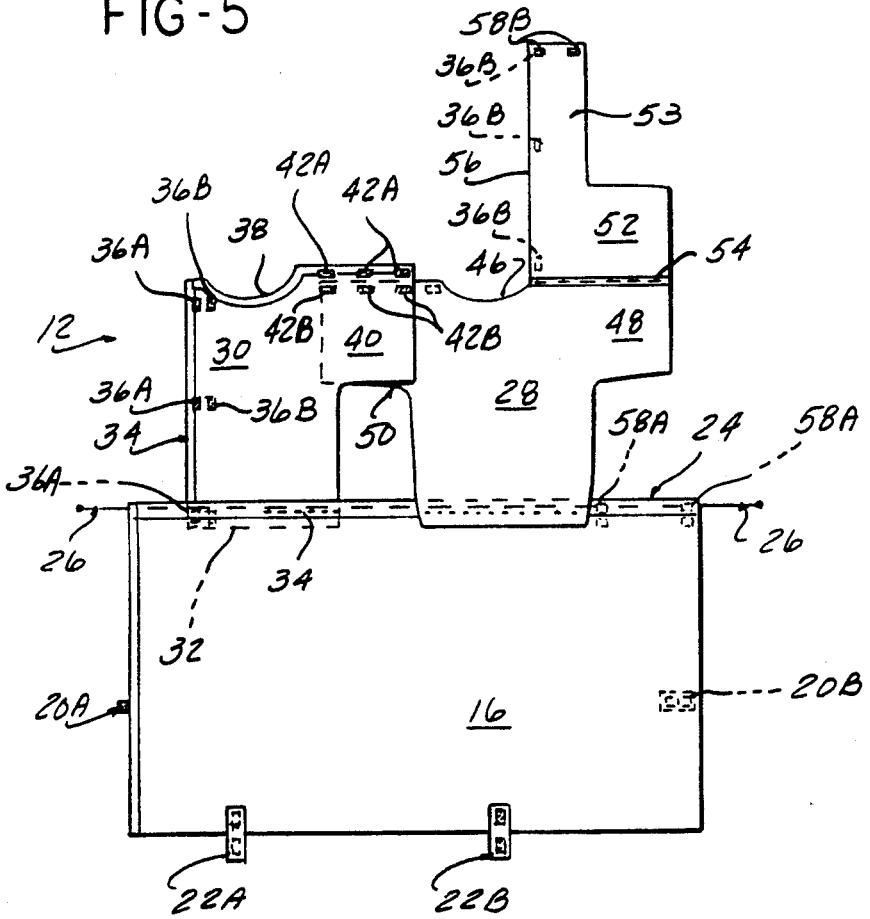
FIG. 4 is a plan view of the gown with the various panels opened and laid flat.

The upper body portion 12 of the gown includes a fabric back panel 28 and a fabric front panel 30 each separately joined to the waist edge of the panel 16, as best seen in FIG. 4.

The front panel 30 has a lower edge 32 sewn to the nether panel 16 along a seam 34 extending for only a part of the length thereof, the remaining portion forming a flap having a vertical edge 34 provided with a series of hook elements 36A of hook and loop fasteners 36. A series of mating loop elements 36B are sewn immediately adjacent the hook elements 36A so that there may be covered during laundering as will be discussed further herein.

A neck cutout 38 is provided as well as a right sleeve half 40. A series of hook elements 42A of a series of fasteners 42 are distributed along the upper edge 44 of the sleeve 40. A corresponding series of loop elements 42B are sewn adjacent the hook elements 42A which may be folded atop these to protect the hook elements 42A during laundering.

The rear panel 28 is sewn along its bottom edge to the waist edge of the panel 16 at the rear thereof. The rear panel has a collar cutout 46 as well as left and right rear sleeve portions 48, 50. A matching series of loop elements 42B are sewn along the top of the right rear sleeve portion 50 to enable a releasable seam at the top of the right sleeve formed by bringing together rear sleeve portion 50 with front sleeve portion 40.

The left rear sleeve portion 48 has a left front sleeve 52 and auxiliary front panel 53 sewn thereto along a seam 54 joining the top edges of each together. The auxiliary front panel 53 is drawn over the shoulder of the wearer down over his chest. The left front auxiliary panel 53 is provided with a series of loop elements 36B located along the vertical edge 56 mating with the series of hook elements 36A on the main front panel 30.

An additional pair of loop elements 58B are provided along the bottom edge 60 of panel 52 matching a pair of aligned hook elements 58A sewn to the top edge of the nether panel 16.

Figure 5:
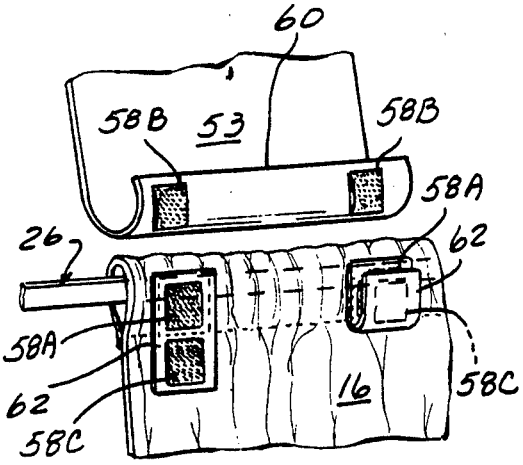
FIG. 5 is an enlarged fragmentary view of the releasable seam between the auxiliary front panel section and the waist edge of the lower portion, showing the details of the hook and loop fasteners, with the seam separated.
Figure 6:
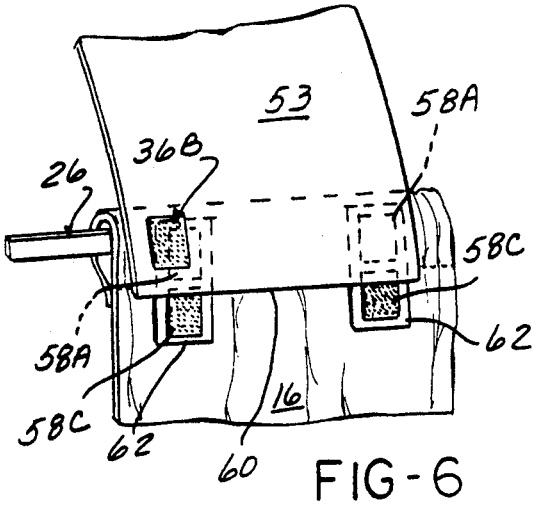
FIG. 6 is the same view as FIG. 5, with the seam secured by the hook and loop fasteners.

In order to protect against the clogging of the various hook elements with lint during laundering, a corresponding cover element is provided as shown in FIGS. 5 and 6 as applied to the hook elements 58A. The loop cover elements 58C are attached to strips 62, allowing the cover loop elements 58C to be folded over the hook elements 58A during laundering, as shown in FIG. 6.

The various openable seams are preferably provided with colored piping 66 to assist hospital staff members in identifying operable seams.

Open slits 70, 72 are formed beneath each of the right and left sleeve assisting in hygienic care of immobile patients.

Thus, the entire right and left side of the chest and/or left or right arms are rendered accessible for treatment or examination without disrobing of the patient.

The lower extremities and anatomy is also accessible for these purposes.

At the same time the garment is well fitted to the patient and comfortable to wear, contributing to the patient's mental well being by providing dignified dress while confined.

The gown is simple and should be able to be made at reasonable cost.

I claim:

1. A patient's hospital gown having a front and rear, said gown comprising:

a lower portion comprising a fabric lower panel able to be wrapped around a patient's waist and forming an overlapped releasable seam at said front of the gown, said lower panel having a top and bottom edge;

a series of releasable fasteners for securing said seam;

a main front panel having a top and bottom edge and inside and outside edges, said main front panel sewn to said top edge of the lower panel to form a seam extending along said bottom edge of said main front panel for a segment of the bottom edge at the outside thereof to form a flap portion comprised of a portion of said main front panel adapted to be drawn across the wearer's chest;

a rear panel having a top and bottom edge, sewn along said bottom edge thereof to said lower panel, said rear panel having left and right sleeve sections, one of said sleeve sections having attached thereto an auxiliary front panel adapted to be drawn down over the wearer's chest and meeting said inside edge of said main front panel to form a releasable flap seam;

a series of releasable fasteners for securing said flap seam;

said main front panel formed with a sleeve section overlying said other sleeve section of said rear panel opposite from said right and left sleeve sections; a releasable seam formed along the top edge of said overlying sleeve sections of said main front panel and rear panel sleeve; and, a series of releasable fasteners for securing said releasable seam.

2. The patient's hospital gown according to claim 1 wherein said main front panel flap portion is releasably secured to said top edge of said lower panel with releasable fasteners.

3. The patient's hospital gown according to claim 1 wherein the bottom edge of said auxiliary front panel is releasably secured to the top edge of said lower panel with releasable fasteners.

4. The patient's hospital gown according to claim 1 wherein said lower portion fabric lower panel is provided with a pair of central releasable fasteners at opposite points of the bottom edge thereof enabling partial bifurcation of said lower portion by connection of said pair of releasable fasteners.

5. The patient's hospital gown according to claim 1 wherein said releasable fasteners comprise hook and loop elements.

6. The patient's hospital gown according to claim 5 further including attached cover loop elements for covering said hook elements during laundering.

7. The patient's hospital gown according to claim 1 wherein said lower portion lower fabric panel is provided with a drawstring at said top edge.

8. The patient's hospital gown according to claim 1 wherein said overlapped seam of said lower portion lower panel and the seam of said front panel flap are approximately aligned to one side at the front of said gown.

* * * * *